US005988440A

United States Patent [19]

Saunders et al.

[11] Patent Number: 5,988,440

[45] Date of Patent: Nov. 23, 1999

[54] SOAP DISPENSER

[75] Inventors: Peter Saunders; William Start; Frederick Charles Frost, all of Essex, United Kingdom

[73] Assignee: F C Frost Limited, Essex, United Kingdom

[21] Appl. No.: 09/051,906

[22] PCT Filed: Oct. 15, 1996

[86] PCT No.: PCT/GB96/02513

§ 371 Date: Apr. 20, 1998

§ 102(e) Date: Apr. 20, 1998

[87] PCT Pub. No.: WO97/14344

PCT Pub. Date: Apr. 24, 1997

[30] Foreign Application Priority Data

Oct. 17, 1995 [GB] United Kingdom ..... 9521218

[51] Int. Cl.[6] ..... B67D 5/46

[52] U.S. Cl. ..... 222/63; 222/333; 222/381

[58] Field of Search ..... 222/52, 63, 644, 222/333, 381, 372

[56] References Cited

U.S. PATENT DOCUMENTS

| | | | |
|---|---|---|---|
| 3,419,188 | 12/1968 | Matchett | 222/52 |
| 4,606,085 | 8/1986 | Davies | 4/263 |
| 4,722,372 | 2/1988 | Hoffmann et al. | 222/52 X |
| 4,938,384 | 7/1990 | Pilolla et al. | 222/63 X |
| 4,946,070 | 8/1990 | Albert et al. | 222/52 |
| 5,031,528 | 7/1991 | Shaw | 4/263 |
| 5,105,992 | 4/1992 | Fender et al. | 222/52 |
| 5,255,822 | 10/1993 | Mease et al. | 222/63 |
| 5,299,713 | 4/1994 | Saithoh | 222/63 X |
| 5,492,247 | 2/1996 | Shu et al. | 222/63 |
| 5,632,414 | 5/1997 | Merriweather, Jr. | 222/63 X |

FOREIGN PATENT DOCUMENTS

| | | |
|---|---|---|
| 0 397 118 A1 | of 1990 | European Pat. Off. . |
| 0 534 743 A1 | of 1991 | European Pat. Off. . |
| 0 468 062 A1 | of 1992 | European Pat. Off. . |
| 295 03 197 | of 1995 | Germany . |

*Primary Examiner*—Kenneth Bomberg
*Attorney, Agent, or Firm*—Baker & Daniels

[57] ABSTRACT

Liquid soap dispenser for sensing the presence of a user's hands in the vicinity of a nozzle (6), and dispensing soap through the nozzle (6) in response to the detection of the user's hands. The dispenser includes a cylinder (10) and a plunger (21) within the cylinder (10), a magnetic core (12) coupled to the cylinder (10) or the plunger (21), and a solenoid (14) which is activated in response to the detection of a user's hands to cause relative movement of the plunger (21) within the cylinder (10) to dispense the soap. Preferably a plurality of dispensers are connected to a single reservoir of liquid soap.

20 Claims, 3 Drawing Sheets

SOAP DISPENSER

The present invention relates to a dispenser for liquid soap.

Soap dispensers in washrooms commonly require a user to depress a nozzle or lever in order to dispense a quantity of soap. In order to improve hygiene, attempts have been made to sense the hands of a user in the proximity of a soap dispenser, and to dispense automatically a measured quantity of soap. Such a system provides improved hygiene, and is useful, for example in hospitals, where users may have difficulty dispensing soap manually.

One known system is a wall mounted dispenser formed as an integrated soap container and outlet and having a battery operated motor which, upon detection of hands in the vicinity of a nozzle rotates a cam to cause the depression of a plunger to push soap out of the nozzle. Such a system operates at low power, and is therefore only capable of use with low viscosity soaps. Also, the physical bulk of the combined container and outlet places severe constraints on where the dispenser can be mounted, and the limited size of the soap container means that it needs frequent refilling.

It has previously been proposed to overcome some of the disadvantages of conventional soap dispensers by using a dispenser mounted, for example, on a counter and connected to a soap reservoir located remotely from the outlet. The reservoir can then be larger than a conventional soap container, and may optionally supply several different outlets. Examples of such systems are disclosed in the present applicant's earlier International application published as W095/20904, in EP-A-534743 (Inax Corporation) and in Canadian application CA 2024788 (Sloan Valve Company). All these prior art systems require relatively powerful and sophisticated pump systems located at the reservoir. For example, the present applicant's above-cited application discloses a system using a peristaltic pump which maintains soap in the supply lines to the outlets continually under pressure. In practice, the relative cost and complexity of the pump and control systems has meant that these prior art soap dispensers have not gained commercial acceptance.

According to the present invention, a liquid soap dispenser comprises a soap dispensing nozzle; a liquid soap reservoir; a plunger and cylinder which are connected between the nozzle and the soap reservoir so that soap is supplied from the reservoir to the cylinder, and from the cylinder to the nozzle upon relative movement in one direction of the plunger within the cylinder; a sensor to detect the presence of the hands of a user in the vicinity of the nozzle; a magnetic core coupled to one of the plunger and cylinder, the core being mechanically connected to a plate; and a solenoid which, in use, attracts the plate to move the core to cause the relative movement of the cylinder and plunger when a current is applied to the solenoid in response to a signal from the sensor indicating the presence of the hands of a user in the vicinity of the nozzle.

The present inventors have found that the use of a solenoid-driven plunger/cylinder pump associated with the outlet produces a system which can function in response to a proximity dectector and with sufficient power to suck soap from a reservoir which may be a few meters from the outlet, and to cope with both high and low viscosity soaps. At the same time this arrangement is sufficiently physically compact to facilitate mounting of the outlet for example on a counter, and can be produced at greatly reduced costs by comparison with prior art systems using, for example, peristaltic pumps.

Preferably, the plunger and cylinder are part of a pump comprising a pump housing which defines therein the cylinder, and a check valve which permits the entry of soap from the soap reservoir when the plunger is moved away from the check valve in a direction opposite to the one direction to allow soap to be sucked from the reservoir, but which closes when the plunger is moved in the one direction towards the check valve, wherein movement of the plunger in the one direction causes the soap to be forced through the centre of the plunger and to the nozzle. In this case, a second valve may be provided at the centre of the plunger and which opens when the pressure in the cylinder reaches a certain level. Additionally, a spring may be positioned between the plunger and the pump housing to return the plunger after the movement in the one direction.

The sensor can be any type of proximity sensor, but is preferably an infrared sensor.

An example of a soap dispenser constructed in accordance with the present invention will now be described with reference to the accompanying drawings, in which.

Figure 1:
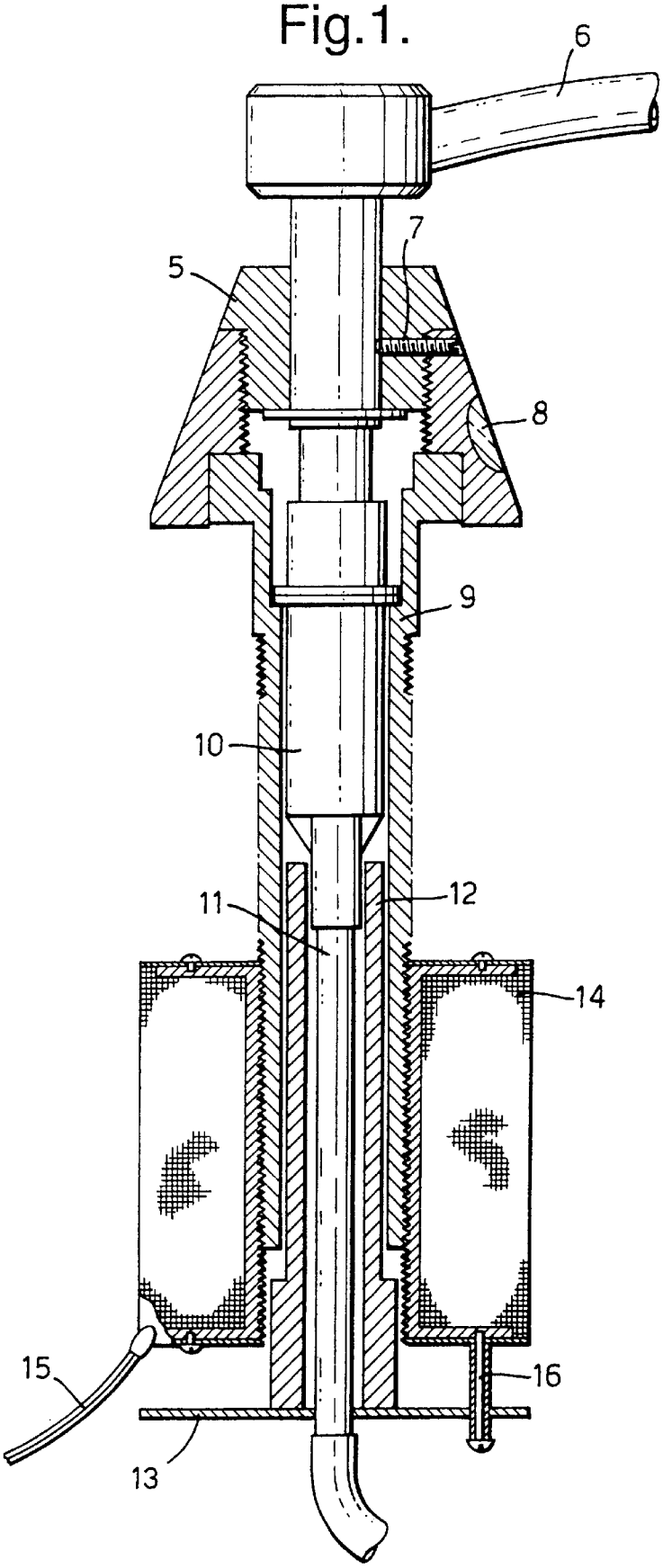
FIG. 1 shows a cross-section of the soap dispenser.

The illustrated soap dispenser is of the kind suitable for mounting to a counter in a washroom adjacent to a basin. The dispenser is mounted with a housing 5 fixed to and projecting above the counter, while the workings of the dispenser below the housing 5 are concealed below the counter. It is apparent that with minor modifications to the orientation of the dispenser components, the dispenser could be mounted in a vertical wall adjacent to a basin.

A soap dispensing nozzle 6 is provided within the housing 5 and is fixed to the housing by a grub screw 7. It is possible for the housing 5 and nozzle 6 to be a one piece component. However, the presence of the grub screw allows the parts of a conventional manually operated soap dispenser to be used with minimal adaptation. In addition, the grub screw 7 can be removed by a janitor in order to prime the system manually, or if there is some failure of the electrical system described below, so that the dispenser reverts to a manual operation. As an alternative to manual priming, the janitor may prime the system by operating the pump via the control systems.

An infrared sensor 8 is mounted in the housing 5 and, in use, is directed towards the basin. The infrared sensor 8 detects the presence below the nozzle 6 of the hands of a user.

A hollow fixing stem 9 extends downwardly from the housing 5 and, in use, will extend through the counter to which the dispenser is mounted. A pump unit 10 is mounted within the fixing stem 9 directly below the nozzle 6. The pump 10 is supplied with the liquid soap through a dip tube 11 from a soap reservoir, such as a bottle (not shown). As many as four soap dispensers may be fed with the soap from a single bottle.

The portion of the dip tube 11 within the fixing stem 9 is surrounded by a hollow metal core pin 12 which has a metal plate 13 at its lower end. The lower end of the fixing stem 9 is surrounded by a solenoid coil 14 which is fed with mains power via a transformer (not shown) through a power line 15. The supply of power to the solenoid coil 14 causes upward movement of the core pin 12 and plate 13 which, in turn, lifts the pump unit 10 to dispense soap from the nozzle 6 in a manner to be described. A stop pin 16 is provided to limit relative movement between the plate 13 and solenoid 14. In this example, the pump is designed to dispense up to 1.5 cc at a time. The volume dispensed may be varied by changing the separation of the plate 13 and the base of the solenoid. When the solenoid is mounted to the pump via a screw thread on its inner surface, then this may be done by moving the solenoid up or down the pump body.

Figure 2:
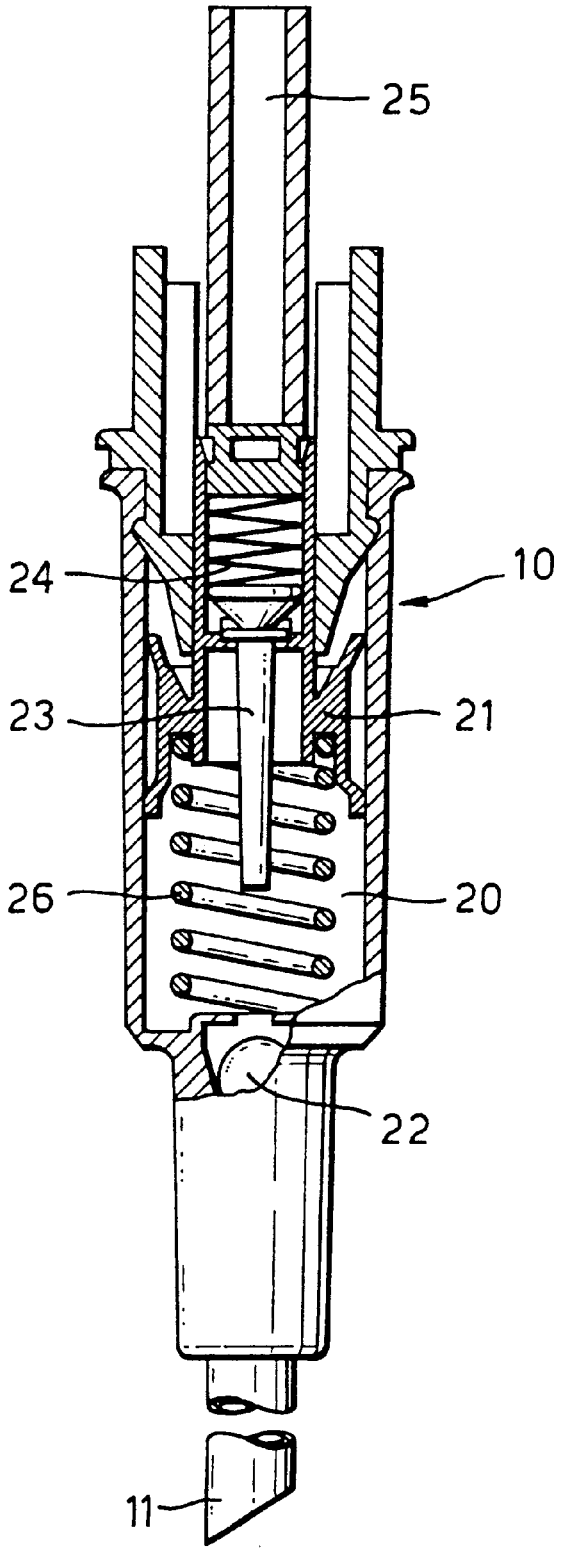
FIG. 2 is an enlarged cut away section showing the details of the pump unit of FIG. 1.

The detailed workings of the pump unit 10 are shown in FIG. 2. The pump unit defines a cylindrical chamber 20 in which a plunger 21 is reciprocatable. The plunger 21 is fixed with respect to the nozzle 6, so that the previously described upward movement of the pump unit causes the chamber 20 to move with respect to the plunger. A ball check valve 22 is provided at the lower end of the chamber 20 to control the flow of the soap from the dip tube 11 into the chamber 20. The plunger 21 has a central opening 23 which communicates via a spring valve 24 with a conduit 25 leading to the nozzle 6. A compression spring 26 biases the piston away from the lower end of the chamber 20. The spring applies to the soap, via the pump, a peak pressure of 3.7 lbs/sq. in.

In use, when the hands of a user are placed under the nozzle, this is detected by the infrared sensor 8. A current is then supplied to the solenoid 14 to cause upward movement of the core pin 12. The upward movement is aided by attraction between the plate 13 and the solenoid 14. The upward movement of the core pin 12 lifts the pump body against the action of the tension spring 26.

When the pump unit 10 is lifted upwardly, the pressure within the chamber 20 begins to rise forcing the ball of the ball check valve 22 down onto its seat to ensure that pressure is not lost in the dip tube 11. When the pressure reaches a certain level, the spring valve 24 opens, so that further upward movement of the pump unit 10 causes liquid soap to be dispensed from the chamber 20 up through the centre of the piston 21, through the conduit 25 and out through the nozzle 6. The soap is dispensed until the pump unit 10 has reached its uppermost position. Prior to reaching this position, the power to the solenoid is cut, so that the last part of the upward motion of the pump unit 10 occurs under the momentum previously imparted by the solenoid 14. The pump unit is then returned to its lowermost position 10 by the action of the compression spring 26. During this motion, the spring valve 24 closes and the ball of the ball check valve 22 is lifted from its seat so that, as the pump unit 10 moves downwardly, soap is sucked into the chamber 20 ready for the next operation of the pump.

When more than one pump dispenser is fed from the same soap bottle, each dispenser control circuit may be provided with a lock-out timer which prevents operation of the or another soap dispenser in the two seconds following the operation of a first dispenser. In addition, a soap level detector may be provided in the soap bottle so that when the level of soap drops below a certain level, the solenoid mechanism can be disabled, and instead the user can be provided with an audible or visual signal indicating that no soap is available.

Figure 3:
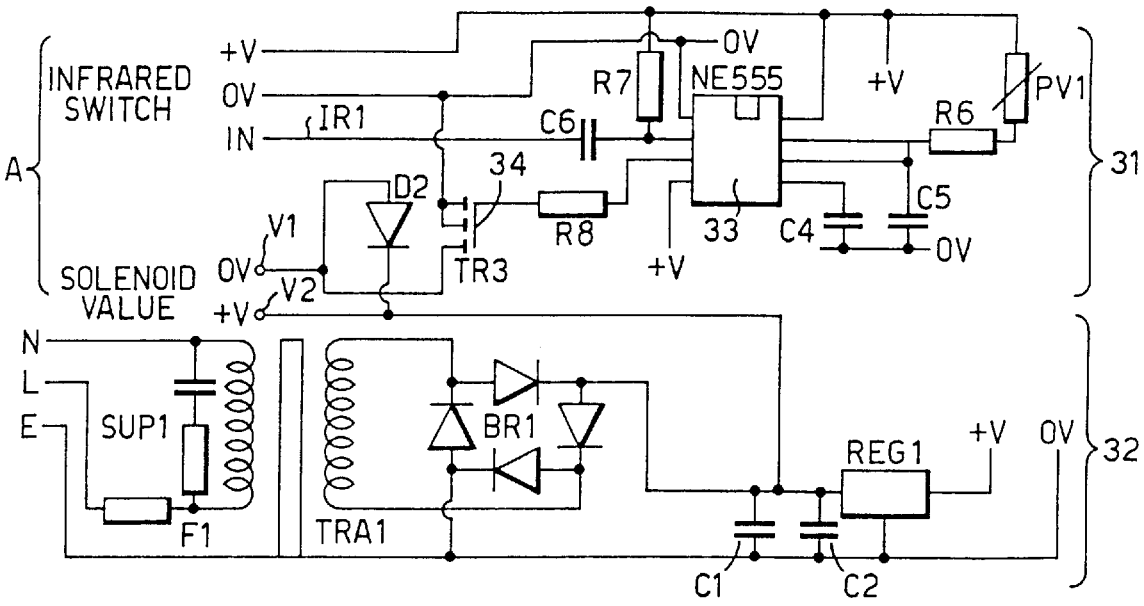
FIG. 3 is a circuit changer showing a timer/control circuit.

FIG. 3 is a circuit diagram showing the circuitry associated with the soap dispenser. This comprises a power supply stage 32 connected to the mains and control/timer circuits 31. The control/timer circuits include an integrated circuit timer 33 which drives a semiconductor switch 34. When turned ON, the switch 34 causes a voltage V to be applied across output terminals V1, V2 which are in turn connected to the solenoid. In the present example, the value of V is 12 volts.

Figure 4:
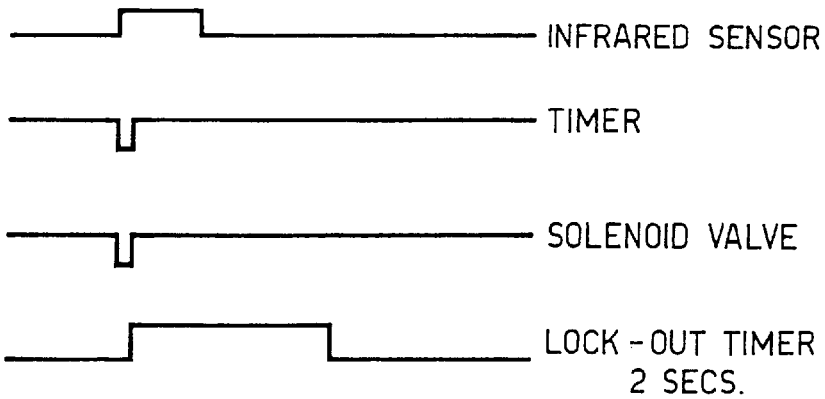
FIG. 4 is a timing diagram.

FIG. 4 is a timing diagram for the dispenser. In response to a rising edge from the infra red sensor, the timer produces a negative-going output pulse of 0.5 seconds which switches on the solenoid valve for a corresponding period.

As discussed above, optionally a lock out timer may be activated as the timer and the solenoid valve turn OFF to prevent re-activation of the valve for a period of, for example, two seconds.

Table TF2 below lists the dimensions of the pump shown in FIG. 2.

TABLE TF2

| LENGTHS (mm) | DIAMETERS (mm) |
|---|---|
| L1 69.0 | ϕA 7.0 |
| L2 11.0 | ϕB 12.75 |
| L3 11.0 | ϕC 17.5 |
| L4 14.0 | ϕD 13.5 |
| L5 16.0 | ϕE 11.5 |
| L6 58.0 | ϕF 6.5 |

We claim:

1. A liquid soap dispenser comprises:

a soap dispensing nozzle (6);

a liquid soap reservoir;

a plunger (21) and a cylinder (10) connected between the nozzle (6) and the reservoir so that soap is supplied from the reservoir to the cylinder (10) and from the cylinder (10) to the nozzle (6) upon relative movement in a dispensing direction of the plunger (21) within the cylinder (10);

a sensor (8) for detecting the presence of the hands of a user in the vicinity of the nozzle (6);

a magnetic core (12) coupled to the plunger (21) or the cylinder (10) the core (12) being mechanically connected to a plate (13); and, a solenoid (14) which, in use, attracts the plate (13) to move the core (12) to cause relative movement of the cylinder (10) and plunger (21) when a current is supplied to the solenoid (14) in response to a signal from the sensor (8) indicating the presence of the hands of a user in the vicinity of the nozzle (6).

2. A liquid soap dispenser according to claim 1, in which the plunger (21) and cylinder (10) form part of a pump, the pump comprising a check valve (22) which opens to suck soap from the reservoir into the cylinder (10) upon relative movement of the plunger (21) within the cylinder (10) in a direction opposite to the dispensing direction, and which closes upon relative movement of the plunger (21) within the cylinder (10) in the dispensing direction.

3. A liquid soap dispenser according to claim 2, in which the check valve (22) is a ball valve.

4. A liquid soap dispenser according to claim 3, in which the plunger (21) includes an opening (23) through which the liquid soap is forced to the nozzle (6) upon relative movement of the plunger (21) within the cylinder (10).

5. A liquid soap dispenser according to claim 3, in which the plunger (21) and cylinder (10) are biassed with respect to each other in the direction opposite the dispensing direction.

6. A liquid soap dispenser according to claim 3, in which the sensor (8) is an infra-red sensor.

7. A liquid soap dispenser according to claim 2, in which the plunger (21) includes an opening (23) through which the liquid soap is forced to the nozzle (6) upon relative movement of the plunger (21) within the cylinder (10).

8. A liquid soap dispenser according to claim 2, in which the plunger (21) and cylinder (10) are biassed with respect to each other in the direction opposite the dispensing direction.

9. A liquid soap dispenser according to claim 2, in which the sensor (8) is an infra-red sensor.

10. A liquid soap dispenser according to claim 1, in which the plunger (21) includes an opening (23) through which the liquid soap is forced to the nozzle (6) upon relative movement of the plunger (21) within the cylinder (10).

11. A liquid soap dispenser according to claim 10, further including a valve (24) for closing the opening (23) of the plunger (21) when the pressure in the cylinder (10) is below a predetermined level.

12. A liquid soap dispenser according to claim 11, in which the plunger (21) and cylinder (10) are biassed with respect to each other in the direction opposite the dispensing direction.

13. A liquid soap dispenser according to claim 11, in which the sensor (8) is an infra-red sensor.

14. A liquid soap dispenser according to claim 10, in which the plunger (21) and cylinder (10) are biassed with respect to each other in the direction opposite the dispensing direction.

15. A liquid soap dispenser according to claim 10, in which the sensor (8) is an infra-red sensor.

16. A liquid soap dispenser according to claim 1, in which the plunger (21) and cylinder (10) are biassed with respect to each other in the direction opposite the dispensing direction.

17. A liquid soap dispenser according to claim 10, in which the plunger (21) and cylinder (10) are biassed with respect to each other by a compression spring (26).

18. A liquid soap dispenser according to claim 1, in which the sensor (8) is an infra-red sensor.

19. A plurality of liquid soap dispensers, each according to claim 1, and having a common liquid soap reservoir.

20. A plurality of liquid soap dispensers according to claim 19, each liquid soap dispenser including a lock-out timer which prevents the operation of the or another liquid soap dispenser for a predetermined period after the operation of the said liquid soap dispenser.

* * * * *